US009604834B2

(12) United States Patent
Clusserath et al.

(10) Patent No.: US 9,604,834 B2
(45) Date of Patent: Mar. 28, 2017

(54) FILLER ELEMENT COMPRISING A TRINOX TUBE

(71) Applicant: KHS GmbH, Dortmund (DE)

(72) Inventors: Ludwig Clusserath, Bad Kreuznach (DE); Dieter-Rudolf Krulitsch, Bad Kreuznach (DE); Manfred Hartel, Bretzenheim (DE)

(73) Assignee: KHS GmbH, Dortmund (DE)

( * ) Notice: Subject to any disclaimer, the term of this patent is extended or adjusted under 35 U.S.C. 154(b) by 285 days.

(21) Appl. No.: 14/363,921

(22) PCT Filed: Nov. 27, 2012

(86) PCT No.: PCT/EP2012/004888

§ 371 (c)(1),
(2) Date: Jun. 9, 2014

(87) PCT Pub. No.: WO2013/083244

PCT Pub. Date: Jun. 13, 2013

(65) Prior Publication Data

US 2015/0013833 A1 Jan. 15, 2015

(30) Foreign Application Priority Data

Dec. 7, 2011 (DE) ..... 10 2011 120 372

(51) Int. Cl.
*B65B 31/00* (2006.01)
*B67C 3/00* (2006.01)
(Continued)

(52) U.S. Cl.
CPC ..... *B67C 3/007* (2013.01); *B67C 3/06* (2013.01); *B67C 3/225* (2013.01); *B67C 3/262* (2013.01); *B67C 3/2617* (2013.01)

(58) Field of Classification Search
CPC ..... B67C 3/02–3/1206; B67C 3/262; B67C 3/2617; B67C 3/225; B67C 3/007
See application file for complete search history.

(56) References Cited

U.S. PATENT DOCUMENTS 3,589,410 A * 6/1971 Manas ..... B65B 57/06 141/141
5,054,527 A * 10/1991 Rozier ..... B24B 53/001 141/147

(Continued)

FOREIGN PATENT DOCUMENTS

DE 4304808 8/1994
DE 10025577 2/2001

(Continued)

*Primary Examiner* — Timothy L Maust
*Assistant Examiner* — Randall Gruby
(74) *Attorney, Agent, or Firm* — Occhiuti & Rohlicek LLP

(57) ABSTRACT

A filler element includes a housing, a channel formed therein, a valve in the channel, an opening downstream from the valve that dispenses content into a container when the valve is open, a tube for fill-level adjustment, a controlled gas channel, and a collection space. The tube, which adjusts a fill level of content in the container, projects past the dispensing opening and extends into an interior of the container during filling thereof. This tube connects to a collection space separated from a content vat from which the content comes through the channel. To adjust the desired fill level, a gas pressure is applied to the interior through the tube, thereby displacing excess content from the container. The controlled gas channel permits the gas to enter the container interior.

14 Claims, 3 Drawing Sheets

(51) Int. Cl.

| | |
|---|---|
| ***B67C 3/06*** | (2006.01) |
| ***B67C 3/26*** | (2006.01) |
| ***B67C 3/22*** | (2006.01) |

(56) References Cited

U.S. PATENT DOCUMENTS 5,080,147 A * 1/1992 Millet ..... B67C 3/26 141/147
5,082,033 A 1/1992 Weiss
5,501,253 A * 3/1996 Weiss ..... B67C 3/2614 141/198
6,131,624 A * 10/2000 Paradies ..... B67C 3/2608 141/286
6,470,922 B2 * 10/2002 Sindermann ..... B67C 3/10 141/37
6,601,618 B2 * 8/2003 Tsukano ..... B67C 3/10 141/290
7,958,917 B2 * 6/2011 Conforti ..... B67C 3/10 141/198
8,201,593 B2 * 6/2012 Conforti ..... B67C 3/007 141/192
8,517,065 B2 * 8/2013 Conforti ..... B67C 3/06 141/146
2007/0006939 A1 * 1/2007 Clusserath ..... B67C 3/2628 141/40
2010/0071802 A1 * 3/2010 Clusserath ..... B65B 39/001 141/44
2010/0071803 A1 * 3/2010 Clusserath ..... B67C 3/04 141/65
2010/0307639 A1 * 12/2010 Goldbrunner ..... B67C 3/262 141/301
2011/0197996 A1 * 8/2011 Clusserath ..... B67C 3/001 141/311 R
2011/0272057 A1 * 11/2011 Clusserath ..... B67C 3/06 141/1
2011/0277881 A1 * 11/2011 Gruber ..... B67C 3/22 141/266
2011/0290374 A1 * 12/2011 Clusserath ..... B67C 3/06 141/67
2013/0061980 A1 * 3/2013 Clusserath ..... B67C 3/2622 141/7
2015/0013833 A1 * 1/2015 Clusserath ..... B67C 3/06 141/5

FOREIGN PATENT DOCUMENTS

| | | |
|---|---|---|
| DE | 102005003222 | 7/2006 |
| DE | 102007009435 | 8/2008 |
| DE | 102009016322 | 10/2010 |
| EP | 1262446 | 12/2002 |
| EP | 1544157 | 6/2005 |

* cited by examiner

FILLER ELEMENT COMPRISING A TRINOX TUBE

RELATED APPLICATIONS

This application is the US National Stage under 35 USC 371 of PCT application PCT/EP2012/004888, filed on Nov. 27, 2012, which claims the benefit of the priority date of German application DE 10 2011 120 372.2, filed on Dec. 7, 2011. The content of the foregoing applications is incorporated herein by reference.

FIELD OF INVENTION

The invention relates to container processing, and in particular, to filling containers.

BACKGROUND

In the Trinox filling method, a probe-type tube that is open at both ends, sometimes called a "Trinox tube," is used as a fill-level-determining element. The bottom end of the tube extends into the container, which is in a sealed position with the filler element.

To carry out the filling procedure, one begins by overfilling the container so that the fill level is above the desired fill level. As a result, the Trinox tube extends below the surface of the content. To reach the desired fill level, one applies a pressurized gas, sometimes referred to as a "Trinox gas," to the container head space that is not occupied by the content. This forces content out of the container through the Trinox tube until the Trinox tube emerges from below the level of the content. At this point, the desired fill level is set.

A disadvantage of known methods is that the content ejected out of the container by of the Trinox tube is returned into the content vat. To the extent the ejected content has come in contact with a contaminated container, there is a risk that contaminated content will find its way into the content vat.

SUMMARY

The invention provides a way to avoid the risk that liquid content returned to the content vat will be contaminated.

In one aspect, the invention features a filler element that includes a housing, a channel formed therein, a valve in the channel, an opening downstream from the valve that dispenses content into a container when the valve is open, a tube for fill-level adjustment, a controlled gas channel, and a collection space. The tube, which adjusts a fill level of content in the container, projects past the dispensing opening and extends into an interior of the container during filling thereof. This tube connects to a collection space separated from a content vat from which the content comes through the channel. To adjust the desired fill level, a gas pressure is applied to the interior through the tube, thereby displacing excess content from the container. The controlled gas channel permits the gas to enter the container interior.

In another aspect, the invention features an apparatus for processing containers. Such an apparatus has a filler element for the filling of containers with liquid content. The filler element has a filler-element housing, a liquid channel formed in the filler element housing, a liquid valve in the liquid channel, a dispensing opening downstream from the liquid valve, with downstream being defined by a flow direction of the content, a tube for adjusting a desired fill level of content in the container, a controlled gas channel, and a collection space. The content is made available in a content vat from which content can flow through the liquid channel. The dispensing opening dispenses content into a particular container when the liquid valve is open. The tube has a first open end projecting past the dispensing opening and extending into an interior of the container during filling thereof. To adjust the desired fill level, a gas pressure is applied to the interior through the tube, thereby displacing excess content from the container. The controlled gas channel permits application of the gas into the container interior. The tube is connected to the collection space, which is separated from the content vat.

Some embodiments include a control valve that connects the tube to the collection space.

Other embodiments include a valve that connects the collection space to the content vat. This valve can be a stop valve, in some embodiments, or a switchover valve, in other embodiments.

Other embodiments include a pipe connected to the collection space for draining content. The collection space is connected to the pipe via a valve, which can be a stop valve or a switchover valve. Among these embodiments are those that further include an installation for processing the content, with the pipe being connected to the installation.

In some embodiments, collection space jointly serves a plurality of filler elements. Among these are embodiments in which the collection space is an annular channel.

Other embodiments include a rotary filling machine having a circulating rotor. In these embodiments, the filling element, together with a plurality of additional filling elements, is disposed on the circulating rotor.

In yet other embodiments, the tube is a trinox tube.

In another aspect, the invention features a method for filling a container with liquid content supplied from a content vat. Such a method includes extending a tube, for example, a trinox tube, into the container, upon completion of over-filling the container, passing gas through the tube to achieve a desired fill level of content by using gas pressure to force excess content out of a head space of the container, and causing content displaced by the gas pressure to be collected in a collection space separated from the content vat.

Some practices of the method include returning the content collected in the collection space to the content vat. Among these practices are those that include processing the content collected in the collection space prior to returning the content to the content vat.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

As used herein, the word "containers" refers to cans, bottles, tubes, pouches, whether made of metal, glass and/or plastic, as well as other packaging means that are suitable for filling with liquid or viscous products.

As used herein, the term "fill-level-controlled filling" means a controlled filling of the containers such that, at the end of the particular filling process, they are filled with the liquid content up to a desired fill level.

As used herein, the term "fill-level-determining element" is an element, preferably a probe-type or tube-type element, that extends into the container during filling and with which the desired fill level is controlled and/or set.

As used herein, the words "basically" or "approximately" mean deviations from the exact value in each case by +/−−10%, and preferably by +/−5% and/or deviations in the form of changes not significant for function.

BRIEF DESCRIPTION OF THE DRAWINGS

These and other features and advantages of the invention will be apparent from the following detailed description and the accompanying figures, in which.

DETAILED DESCRIPTION

Figure 1:
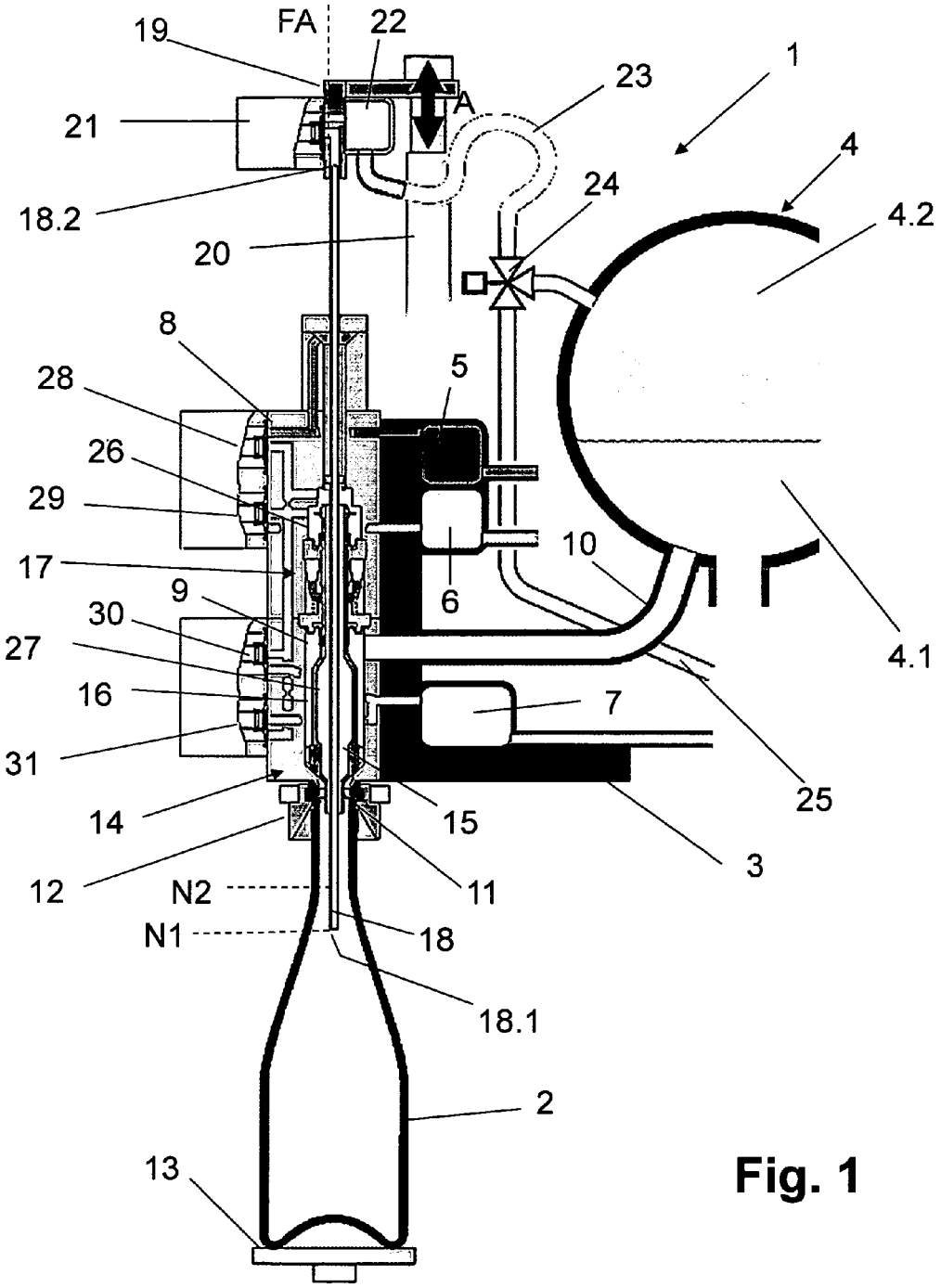
FIGS. 1-3 show simplified representations of a filling element of a filling system or a filling machine of a rotary design for the fill-level-controlled filling of containers in the form of bottles with liquid content.

FIG. 1 shows a filler element 1 mounted on part of a rotary filling machine for the fill-level-controlled filling of containers, in the form of bottles 2, with liquid content.

The rotary filling machine has a multiplicity of the same kind of filler elements 1 on the circumference of a rotor 3 that can be driven to rotate around a vertical machine axis. An annular vat 4 supplies liquid content for all the filler elements 1 of the filling machine jointly.

During the filling operation, the annular vat 4 is partially filled with liquid content. As a result, within the annular vat 4, there exists a lower liquid space 4.1 and, above it, a gas space 4.2. For pressure filling of bottles, a pressurized inert gas, for example $CO_2$ gas, occupies the gas space 4.2.

Three annular channels 5,6,7 have different functions depending on the filling method. The first annular channel 5 supplies a pressurized Trinox gas, i.e. a pressurized inert gas, which is for example $CO_2$ or nitrogen. The second annular channel 6 supplies a pressurized compressed gas, i.e. a pressurized inert gas, for example, $CO_2$ gas. The third annular channel 7 supplies a vacuum or negative pressure.

The filler element 1 comprises a filler element housing 8, in which a liquid channel 9 is formed. A product pipe 10 connects an upper part of the liquid channel 9 to the lower liquid space 4.1 of the annular vat 4 by a product pipe 10. On the underside of housing 8, the liquid channel 9 forms an annular dispensing opening 11 through which, during filling, the liquid content flows into the bottle 2. The bottle 2 has its bottle mouth lying in a sealed position against the filler element. A centering cone 12 provides the sealin the area of the dispensing opening 11. A container carrier or bottle plate 13 raises the bottle into a sealed position against the filler element 1.

A liquid valve 14 with a valve body 15 is provided in the liquid channel 9. The valve body 15 interacts with a valve surface in the liquid channel 9. It is made on a gas tube 16 arranged to be coaxial with a vertical filler element axis FA, or on a section of this gas tube 16 that has a widened cross-section. The valve body 15 acts as a valve plunger.

The gas tube 16 protrudes through the dispensing opening 11 above the underside of the filler element 1 and thus extends, during the filling, into the relevant bottle 2 or into a head space thereof. For the controlled opening and closing of the liquid valve 14, an actuation device 17, which is pneumatic in the illustrated embodiment, acts on the gas tube 16. The actuating device 17 is housed in an inner space of the housing 8, where it is separated and sealed from the liquid channel 9.

The filler element 1 has a probe-type tube 18 arranged to be coaxial with a filler element axis FA. The gas tube 16 encloses, but is spaced apart from, this probe-type tube 18. The probe-type tube 18, or Trinox tube 18, is open at both ends thereof. During the filling operation, a lower open end 18.1 of the tube 18 extends into the top area of the head space of the bottle and projects over the lower open end of the gas tube 16.

The Trinox tube 18 is fed through the filler element housing 8. A top section forming an upper end 18.2 projects over the top of the housing 8 and is held on a support arm 19 or support ring of an adjustment device 20. Axial movement of the Trinox tube 18 in the direction shown by the double arrow A sets the fill level to which the bottles 2 are each filled with liquid content.

A control valve 21 connects the upper end 18.2 of the Trinox tube 18 to an annular channel 22. The annular channel 22 is also common to all the filler elements 1 of the filling machine or the filling system. In the illustrated embodiment, the annular channel 22 serves as a content collection channel. The annular channel 22, together with the control valve 21, is provided on the support arm 19.

A flexible pipe 23 connects the annular channel 22 to a preferably electrically-actuated switchover valve 24. The switchover valve 24 selectively connects the annular channel 22 to the annular vat 4. In doing so, the switchover valve 24 causes liquid content collected in the annular channel 22 to empty into either the content vat 4 or into a pipe 25 that leads to a content-processing installation.

The content-processing installation processes the content drained from the annular channel 22 during the emptying prior to returning it to the content vat 4. Processing steps could include one or more of filtering, heating to a specified temperature, sterilizing, and carbonating. Following processing by the content-processing installation, the content is returned to the content vat 4. Following these processing steps, the liquid content is fed to another use, for example returned to the content vat 4.

The upper open end of the gas tube 16, or a gas channel 27 formed between the inner surface of the gas tube 16 and the outer surface of the Trinox tube 18, opens into a gas space 26 inside the housing 8. In addition, various controlled gas paths with control valves 28-31 are provided in the housing 8 to connect the gas channel 27 to the annular channels 5, 6, 7 in a controlled manner as described in more detail below.

The filler element 1 thus makes it possible to pressure fill bottles 2 using the Trinox filling method. The filling operation starts with axially adjusting the tube 18 to set the desired fill-level. In particular, the lower open end 18.1 of the tube 18 defines the desired fill level (level N1) reached at the end of the filling process.

The liquid valve 14 and all the control valves 21, 28-31 are initially closed. A bottle plate 13 raises the empty bottle against the filler element 1 and seals its bottle opening against the filler element 1.

Next, the control valve 30 opens to create a connection between the annular channel 7 and the gas channel 27 connected to the inside of the bottle 2. This evacuates the bottle 2.

After evacuation, the control valve 30 is closed and the control valve 29 is opened. This connects the gas channel 27 to the annular channel 6 to pre-tension the inside of the bottle to the filling pressure with a pressurized inert gas. Before pre-tensioning the bottle, it is possible to purge the inside of the bottle with the inert gas one or more times. To carry this out, one simply carries out the activation sequence of the control valves 29 and 30 as described above as many times as desired.

After the pre-tensioning of the bottle 2 to the filling pressure, with the control valve 29 still open, the liquid valve 14 is opened. As a result, liquid content flows into the bottle through the annular dispensing opening 11 enclosing the gas tube 14. The liquid content entering the bottle forces the inert gas out of the bottle and into the annular channel 6 through the gas channel 27 and the open control valve 29. During this filling phase, the bottle 2 is deliberately overfilled to a level N2 above the level N1 of the desired fill level. Upon reaching the desired overfill level, liquid valve 14 closes to stop further flow of content into the bottle 2.

With the bottle now overfilled, the control valve 28 is opened. This creates a connection between the annular channel 5 and the gas channel 27. Pressurized Trinox gas from the annular channel 5 will then fill the head space in the bottle 2. The control valve 21 is then opened so that the pressurized gas can force liquid content out of the inside of the bottle via the Trinox tube 18 into the annular channel 22. This flow out the tube 18 ends once the the lower open end 18.1 of the Trinox tube 18 is no longer immersed in the contents. At this point, thus the desired fill level (level N1) will have been reached.

The filling process ends with closing the control valves 21, 28. With the liquid valve 14 still closed, for example by opening the valve 31, a release or pre-release of the filled bottle 2 occurs. The bottle plate 13 then lowers the filled bottle from the filler element 1.

It is clear that in particular the process steps before the actual filling phase can also be designed differently from the way described above.

With the filler element 1 or with the filling system having these filler elements, pressure filling is also possible.

In pressure filling, the Trinox tube 18 is used as a fill-level-determining gas return tube. At the end of the filling phase, inert gas forced out of the bottle is returned into the gas space 4.2 of the vat 4. This is carried by closing control valves 28-31, opening liquid valve 14 and control valve 21, and causing the switchover valve 24 to connect the annular channel 22 and the gas space 4.2. The inflow of the contents into the bottle 2 is automatically ended when the lower open end 18.1 of the Trinox tube 18 is immersed by the contents level of the contents that have entered the bottle 2 and a state of equilibrium has been reached between the level of the contents in the annular vat 4 and the content column formed in the Trinox tube 18. The level of the lower open end 18.1 thus in turn determines the fill level (level N1) of the content in the particular bottle 2.

Figure 2:
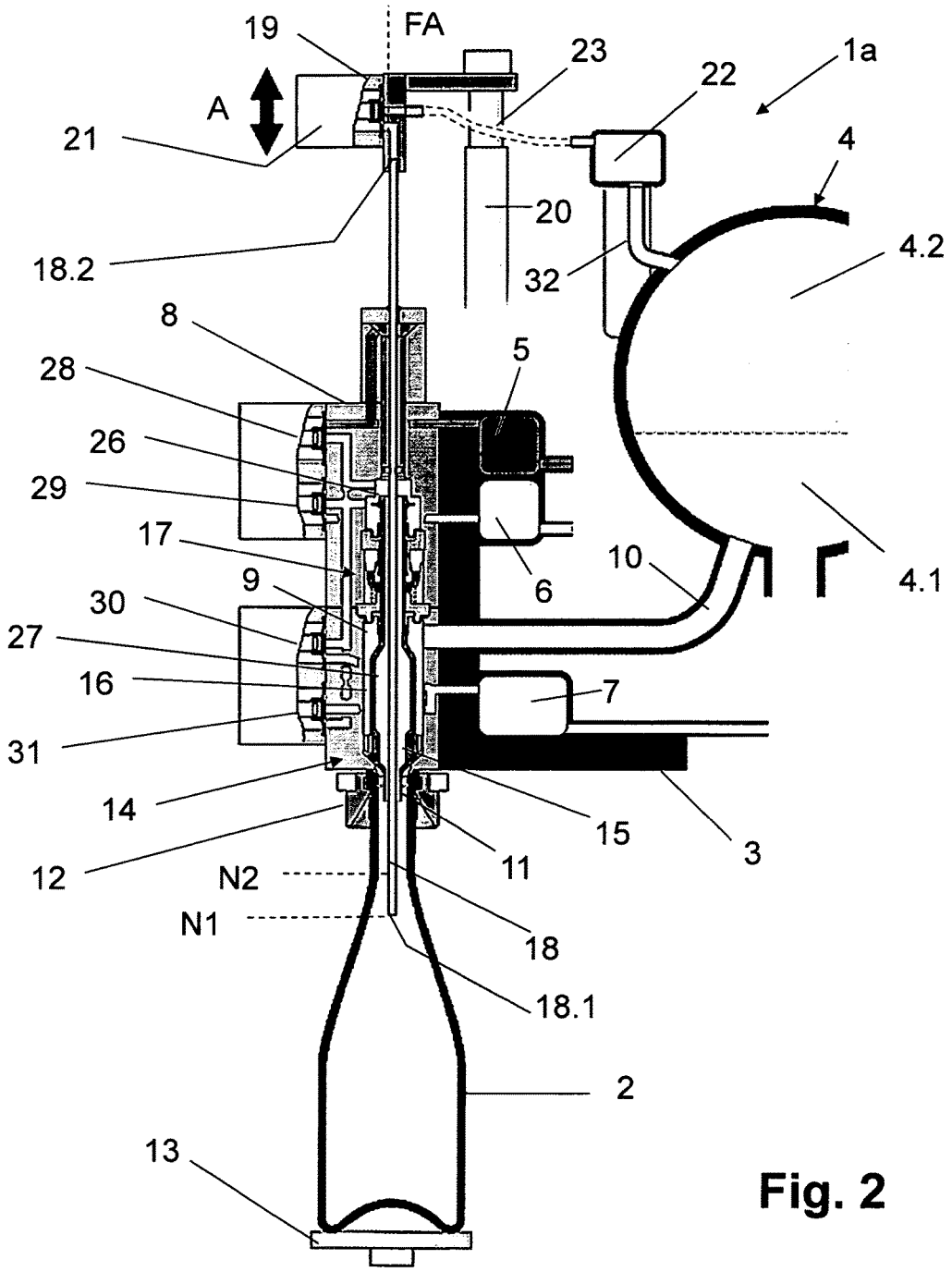

FIG. 2 shows s a further embodiment, a filler element 1*a* that differs from the filler element 1 in that the annular channel 22 is provided on the annular vat 4 and is connected firmly to the annular vat 4 by a pipe 32. The switchover valve 24 and the pipe 25 are not provided. The filler element 1*a* can carry out the same filling methods as the filler element 1.

Figure 3:
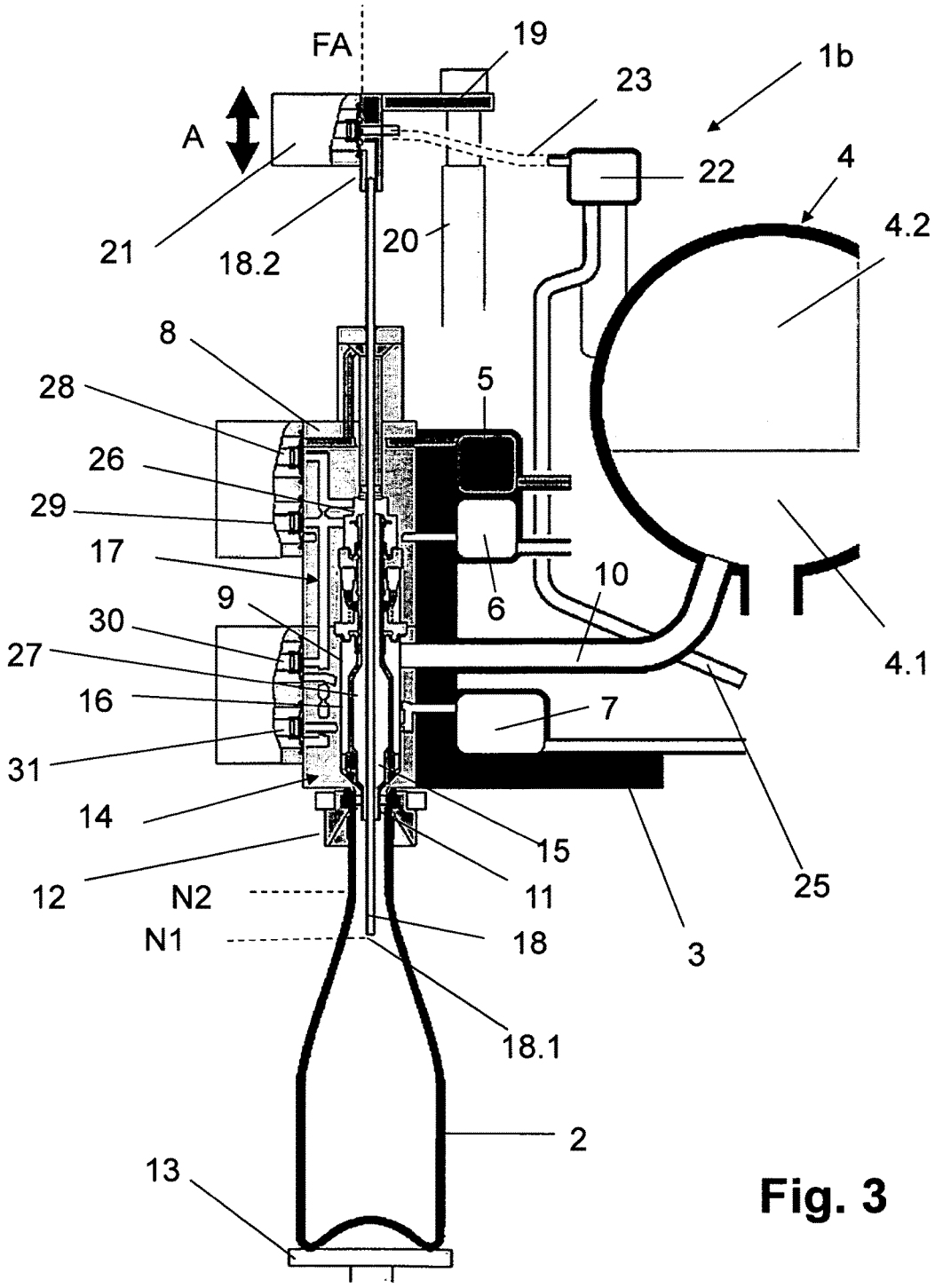

FIG. 3 shows an alternative filler element 1*b*. This alternative embodiment is similar to the filler element 1 except that the annular channel 22 is likewise provided on the annular vat 4 and is connected to the control valve 21 by the flexible pipe 23, and the pipe 25 is connected directly to the annular channel 22. The filler element 1*b* is suitable for Trinox filling methods with processing of the contents collected in the annular channel 22.

The invention has been described above using examples of embodiments. It is clear that numerous modifications and variations are possible without thereby departing from the inventive idea underlying the invention.

Having described the invention, and a preferred embodiment thereof, what is claimed as new, and secured by Letters Patent is:

1. An apparatus for processing containers, said apparatus comprising a filler element for the filling of containers with liquid contents, said filler element comprising a liquid channel, a filler-element housing, a liquid valve, a dispensing opening, a tube for fill-level adjustment, a controlled gas channel, and a collection space, wherein said liquid channel is formed in said filler element housing, wherein said content is made available in a content vat from which content can flow through said liquid channel, wherein said liquid valve is in said liquid channel, wherein said dispensing opening is configured for dispensing content into a particular container when said liquid valve is open, wherein a flow direction of said liquid content defines an upstream direction and a downstream direction, wherein said dispensing opening is provided downstream of said liquid valve, wherein said tube is configured for adjusting a desired fill level of content in said container, wherein said tube comprises a first open end projecting past said dispensing opening and extending into an interior of said container during filling thereof, wherein, to adjust said desired fill level, a gas pressure is applied to said interior through said tube, thereby displacing excess content from said container, and wherein said controlled gas channel permits application of said gas into said container interior, wherein said tube is connected to said collection space, wherein said collection space is separated from said content vat, and wherein said collection space jointly serves plural filler elements.

2. The apparatus of claim 1, further comprising a control valve, wherein said tube is connected to said collection space via said control valve.

3. The apparatus of claim 1, further comprising a stop valve, wherein said collection space is connected to said content vat via said stop valve.

4. The apparatus of claim 1, further comprising a switchover valve, wherein said collection space is connected to said content vat via said switchover valve.

5. The apparatus of claim 1, further comprising a pipe, and a stop valve, wherein said stop valve connects said collection space to said pipe for draining content.

6. The apparatus of claim 5, further comprising an installation for processing said content, wherein said pipe is connected to said installation.

7. The apparatus of claim 1, wherein said collection space is an annular channel.

8. The apparatus of claim 1, further comprising a rotary filling machine, wherein said rotary filling machine comprises a circulating rotor, wherein said filling element, together with a plurality of additional filling elements, is disposed on said circulating rotor.

9. The apparatus of claim 1, wherein said tube is a trinox tube.

10. The apparatus of claim 1, further comprising a pipe, and a switchover valve, wherein said switchover valve connects said collection space to said pipe for draining content.

11. A method comprising filling a container with liquid content using a filler element that comprises a dispensing opening downstream, as defined by a direction of flow of said liquid content, of a liquid valve, said method comprising opening said liquid valve to cause liquid content to be dispensed into said container through said dispensing opening, said liquid content having been supplied from a content vat from which said content flows through a liquid channel formed in a filler-element housing of said filler element, said liquid channel having said liquid valve therein, wherein filling said container further comprises extending, into said container, a first open end of a tube that is connected to a collection space separated from said content vat, said tube being configured for adjusting a desired fill level of content in said container, said first open end projecting past said dispensing opening and extending into an interior of said container, over-filling said container, upon completion of over-filling said container, passing gas through a controlled gas channel that permits application of gas into said container interior and through said tube to achieve a desired fill level of content by using gas pressure to force excess content out of a head space of said container, thereby adjusting said desired fill level by applying a gas pressure to said interior through said tube and displacing excess content from said container, and causing content displaced by said gas pressure to be collected in a collection space separated from said contents vat, wherein said collection space jointly serves plural filler elements.

12. The method of claim 11, further comprising returning said content collected in said collection space to said content vat.

13. The method of claim 12, further comprising processing said content collected in said collection space prior to returning said content to said content vat.

14. The method of claim 11, further comprising selecting said tube to be a trinox tube.

* * * * *